US006647901B2

(12) United States Patent
Somers

(10) Patent No.: US 6,647,901 B2
(45) Date of Patent: Nov. 18, 2003

(54) AUTOMATIC COAL STOKER

(75) Inventor: George E. Somers, Pottsville, PA (US)

(73) Assignee: Keystoker, Inc., Sch. Haven, PA (US)

( * ) Notice: Subject to any disclaimer, the term of this patent is extended or adjusted under 35 U.S.C. 154(b) by 0 days.

(21) Appl. No.: 10/038,444

(22) Filed: Jan. 7, 2002

(65) Prior Publication Data

US 2003/0127029 A1 Jul. 10, 2003

(51) Int. Cl.[7] ..... F23K 3/16
(52) U.S. Cl. ..... 110/109; 110/327; 110/231
(58) Field of Search ..... 110/109, 223, 110/231, 290, 327, 102, 114, 101 R, 218, 219, 281, 282, 286, 289, 267, 293, 104 R, 105, 263, 298, 299, 300, 328; 414/160, 187, 198, 304

(56) References Cited

U.S. PATENT DOCUMENTS 2,119,554 A * 6/1938 Marty ..... 110/38
2,492,585 A * 12/1949 Kohout ..... 110/38
3,081,747 A * 3/1963 Guillou-Keredan ..... 122/225
3,473,493 A * 10/1969 Simpson ..... 110/7
3,839,157 A * 10/1974 Hagstrom ..... 202/117
4,418,816 A * 12/1983 Kropp ..... 198/773
4,537,140 A * 8/1985 Baker ..... 110/281
4,662,290 A * 5/1987 Potts ..... 110/109
4,665,840 A * 5/1987 Yarnell ..... 110/113
4,749,383 A * 6/1988 Mansfield ..... 48/202
4,803,973 A * 2/1989 Harman ..... 126/73
5,050,510 A * 9/1991 Vona et al. ..... 110/257

* cited by examiner

*Primary Examiner*—Ira S. Lazarus
*Assistant Examiner*—K. B. Rinehart
(74) *Attorney, Agent, or Firm*—A. R. Eglington

(57) ABSTRACT

An automatic coal stoker is disclosed having at the base of its hopper an enclosed reciprocating pusher assembly rectangular box shaped which delivers compressingly a defined but variable quantity of coal into a restricted passageway. Successive quantities form a compressed strip of coal to be burned between side rails of a fire grate situate and over an air box fed with a forced air supply. As the strip works its way across the substantially horizontal grate, it burns without forming clinkers, discharges ashes at the bottom of the incline, and effects a minimal degree of uncombusted coal in the ashes. The fire grate of the present invention is substantially horizontal throughout its functional length.

7 Claims, 2 Drawing Sheets

FIG. 1
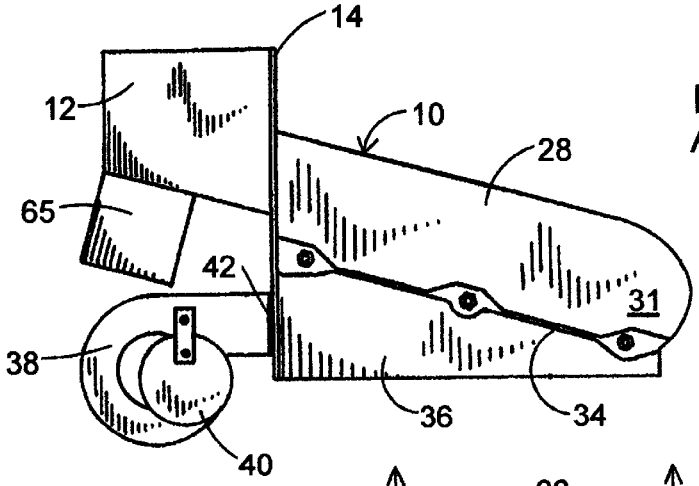
PRIOR ART
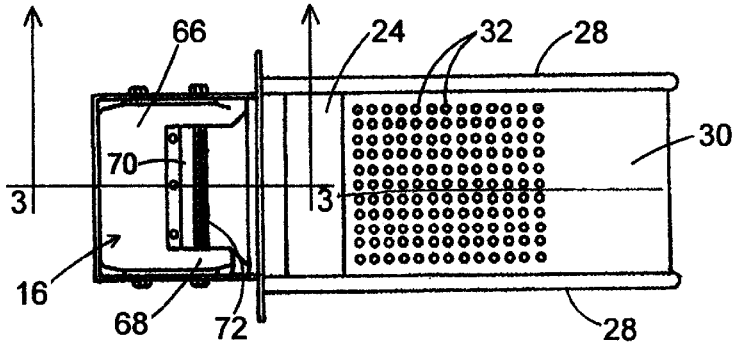
PRIOR ART
FIG. 3
FIG. 2
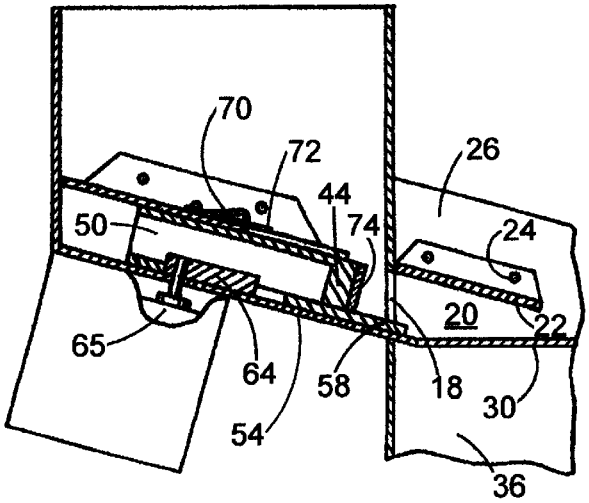

AUTOMATIC COAL STOKER

CROSS-REFERENCE TO OTHER APPLICATIONS

None. This is an examinable patent specification submitted for a filing receipt under Code Section 111 (a).

BACKGROUND OF THE INVENTION

The prior art is best demonstrated by U.S. Pat. No. 4,537,140 to Baker (1985) which has at the bottom of the hopper, a reciprocating, sliding plate with a lip at its rear forming a pusher bar, the plate of which tends to vibrate the infed coal and the pusher, causing the coal to travel down an inclined fire grate. This configuration has no means, however, for accurate regulation of the amount of coal infed nor to break up or prevent the formation of clinkers. Pusher bars of variable reciprocating stroke are generally known. None, however, are designed to keep the bar from contact with the coal or its fine. With wet coal or fines and the gases emitted in the burning thereof, sulfuric and nitric acid are formed which attack the pusher particularly and also cause jamming and excessive wear.

A somewhat modified automatic coal stoker of Potts (U.S. Pat. No. 4,662,290 of May 5, 1987), which also employs a pusher assembly, operated by a cam assembly 64 which reciprocally shifts step-like protuberance 58. It provides an enshrouded pusher which is resistant to attack from such acids. The intermittent pusher assembly of the Potts patent is incorporated by reference here as an ancillary feature of the present invention. The state of the art in the Potts device (1986) includes the long-established perforations 32 of fire grate 30, which grate may be an integral member as depicted, or it may be composed of two or more grate modules that aid loading of the device. Common to the discussed prior art teachings is the plain feature that the grates are sloped downwardly and outwardly from the coal feed line. This has been on the premise that unburned coal in the ash is minimized by gravity. The automatic stoker of Potts claims a grate inclined at an angle of from 14 to 22 degrees, with 18 degrees being the best mode.

According to the present invention, in contrast, the horizontal reorientation of the fire grate demonstrates a more efficient combustion of rice anthracite, then seen heretofore.

It is a principal object of the present invention to employ a substantially horizontal planar fire grate which minimizes fire falling into the underlying ash pan.

A further object of the invention is to burn with a deeper fire bed extracting greater heat from the coal and producing ashes of a more power-like consistency.

Another object of the invention is to induce combustion flames across the internal heat surface of the furnace, thus providing more sensible heat to the area being warmed.

Another object of the modified fire grate component of the present invention is to cause generally vertical flaming from the grate which thus protects the glass fire door from overheating and microcrazing of the glass.

A further object of the invention is to array the infed coal more uniformly across the fire grate so as to cause it to burn more efficiently and to markedly reduce uncombusted coal falling off the grate as part of the ash pan.

Other objects and advantages and features of the invention will be apparent to those skilled in the art from the following description taken in conjunction with the accompanying drawings.

SUMMARY OF THE INVENTION

The invention described herein may be summarized as being an automatic coal stoker having a rear mounted coal hopper adapted to receive rice-sized anthracite. At the hopper bottom, is an enshrouded pusher assembly that provides for intermittent reciprocating action, whereby the rice coal is compacted into a restricted passage, forming a compacted strip form as it moves onto the fire grate (repetitively), have sidewall rails adapted for coal retention on the fire grate which is situated over a forced air feed box. The compacted coal is pushed onto the fire grate which itself is aligned in a substantially horizontal position. The intermittent sliding of compacted coal strips will maximize coal combustion and minimize the minor amount of unburned coal, which is pushed off the grate distal end, for disposal along with the coal ash.

Accordingly, there is provided a coal stoker including a hopper with the lower forward passage, a base box forming a coal ash pan, an elongate planar member having a first inclined section supporting a pusher assembly suited for intermittent feed of compacted coal to the furnace, and an elongate second section comprising a fire grate, either integral or being in modules, both having a multiplicity of perforations therein, which grate also forms the top of a forced air box, the improvement comprising:

Upon positioning, the fire grate section is in a substantially horizontal position throughout its linear length by straddling between the inclined feed first section and the downstream drop off point for coal ash and uncombusted coal.

DESCRIPTION OF THE DRAWINGS

FIG. 1 shows a side elevational view of the stoker assembly of the prior art (identical to FIG. 1 of expired '290 patent to Potts);

FIG. 2 shows a top elevation view of stoker of the prior art depicting perforate fire grate components (identical to FIG. 2 of the '290 patent);

FIG. 3 shows a side vertical cross sectional view of the stoker assembly of the present invention (unloaded) depicting the substantially horizontal disposition of the fire grate component.

DESCRIPTION OF THE PREFERRED EMBODIMENT

Figure 4:
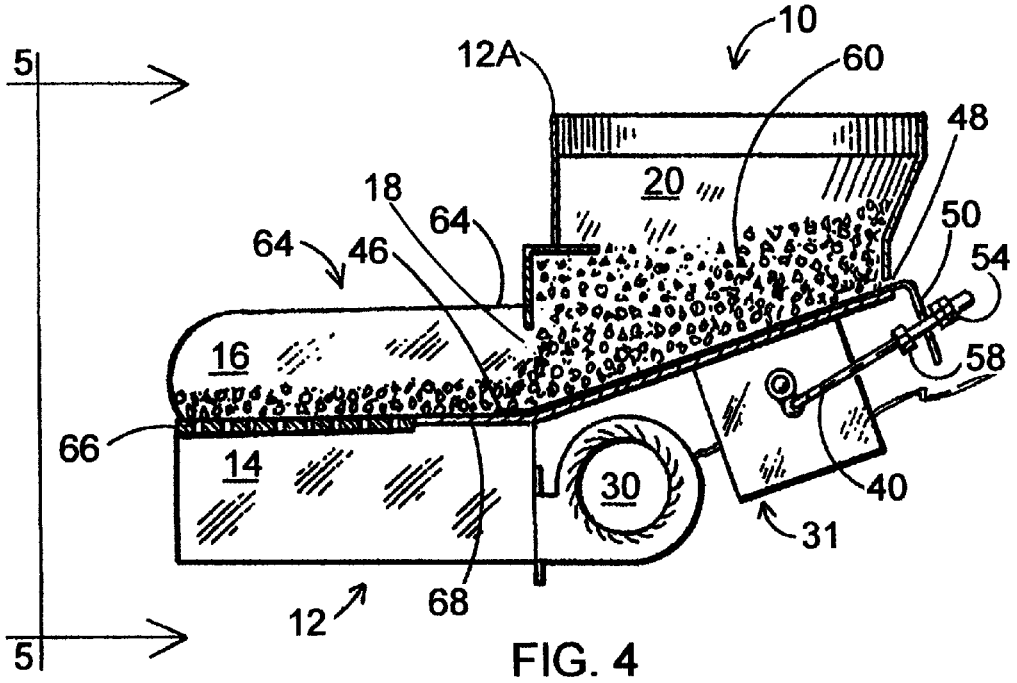
FIG. 4 shows a schematic internal vertical sectional view of the stoker assembly, taken along lines 4—4 of FIG. 2, depicting how the combusting coal transits the fire grate component; and, FIG. 5 is an end elevational view of the stoker depicting the higher sidewall for coal containmnet.

The preferred embodiment is best described by summarizing generally its cooperating elements and providing details of certain elements as require for understanding.

The stoker 10 of the present invention has a rearward upright mounted hopper 12 made of sheet metal, whose furnace side consists of a mounting flange 14. The hopper accepts and stores coal; typically rice-sized anthracite.

At the bottom of the hopper is a covered pusher assembly 16, cf. FIG. 2, which is designed so as to be protected from the generally acidic atmosphere of combustion, particularly if lower grade or wet coal is used. The pusher has a variable stroke (see FIG. 6 of U.S. Pat. No. 4,662,290), and is intermittently slidingly reciprocated (see the '290 FIG. 3*a* with pusher advanced). By this means, the amount of infed coal is regulated and is squeezed compressingly through a port 18 (FIG. 3) in the flange, and into a restricting passageway 20 defined by an upper grate cover 22 roofing over the passage by bolt means 24. The passageway whose sides are formed by upright sidewalls 26 of side rails 28. The top of a planar fire grate 30, which is projected horizontally, ensures that the coal will not heap or run away over the fire grate 30, which grate has a multiplicity of air holes 32 (FIG. 2) disposed therethrough. The fire grate forms the top (FIG. 1) of an air box 36 (FIG. 3), which is forced air fed typically with a 100 CFM squirrel cage, blower (FIG. 1), whose air intake is made variable by a sidewall, swivel cover plate 40. The blower is sealed at its output end to the intake of the air box 36 by a gasket 42.

The pusher assembly (FIG. 3) is a rectangular box-shaped component which has an upper casting 44 forming a top 46. This assembly is described in relation to FIG. 4 of Potts U.S. Pat. No. 4,662,290, which is incorporated here by reference. Cam 64 is attached to a gear motor 65 which typically turns at about 0.75 RPM. The rotation of cam 64 imparts a reciprocal sliding motion to the pusher assembly 58, which, when installed, necessarily gives a vibratory motion to the hopper. An angle bar (not seen) when adjusted in its angle by the adjusting screw, regulates the length of the stroke of the pusher assembly and thereby regulates the amount of infed coal into the passage. The foregoing features are in the art.

Referring now to FIG. 4, there is seen schematically, a partial longitudinal vertical section of a stoker 10. Stoker 10 is illustrated to include a highly perforated, planar grate 66, bottom plate 68, and upright sidewall 16. Coal advances from the hopper (not seen), through a lower sloped passage 18, onto fire grate 66. The action of a pusher plate through the earlier described camming action, enhances the progressive flow of rice coal in an even manner onto the fire grate 66. With the forced air draft from the blower 38, a substantially complete combustion of infed coal is accomplished.

I have determined the enshrouded coal pusher ancillary feature of the Potts patent '290 works more effectively with the modified fire grate 66 of the present invention (FIG. 4). The compacted coal strips traverse grate 66 by a lateral pressure of successive coal feed strips from the described pusher mechanism. The resulting powder-like ash, with minimal unburned coal, drops off the distal transverse edge of the fire grate 66 to the ash pan (not seen). As depicted in FIG. 2, the modules 33A/B, forming the perforated grate 66, may be fabricated in rectangular planar form, with the serial perforations already inscribed. By use of this variable dimension grate modules, the range of fire grate planar dimensions can be readily developed.

Figure 5:
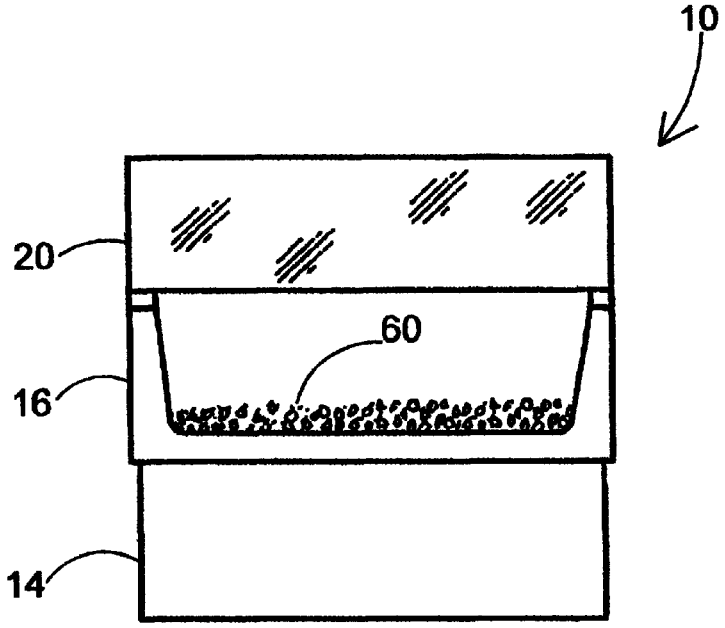

In the end vertical view of FIG. 5, taken along lines 5—5 of FIG. 4, the steeper trough defined by sidewalls 16 abutting the grate component is better seen. The resulting deeper fire bed effects improved combustion of the coal.

In operation, at the start, after a fire is started on the grate, a defined quantity of rice coal is found on the step in front of the pusher which quantity is squeezed compressingly into the passage and held by its restriction. Successive quantities of coal are deposited into the passage with each reciprocation cycle pushing the previous deposit further into the passage. The result of successive deposits is the ejection from the passage of a continuous strip of compressed coal of rectangular cross-section, which works its way across the plane of the fire grate, between the side rails. In this way, as combustion takes place on the grate, clinkers cannot form and ash is continuously cleared from the grate.

As may be understood, the amount of coal delivered for burning can be varied from zero, to typically six 6 pounds, per hour based on cam size, at a maximum and forced air flow regulated accordingly to ensure complete burning. Stack temperature measurements tend to show that up to 85% use of generated BTU's is quite possible, demonstrating a high degree of efficiency. Of course, the principles involved in the current invention would allow for the construction of a much larger capacity stoker than the one disclosed.

EXAMPLE

Comparative performance of coal combustion was conducted using a prior art stoker which provides a prior art inclined fire grate. Such prior art stoker is depicted in FIG. 3A of Potts '290 patent and more graphically, in the prior art stoker of FIGS. 1 and 2 of the instant set of drawings. This is being compared with the substantially horizontal fire grate 30A as described in the present inventive embodiment. The modified grate configuration is sold commercially as the Model Flat Grate by Keystone Manufacturing Co. of Schuylkill Haven, Pa. 17972.

Two successive runs of rice coal were loaded into respective hoppers, 12 and 12A, with the initial coal weight load and total ash weight determined per each run. The burning of 40 lb. of rice anthracite in each stoker was so effected.

The weight of collected ash from operation of the prior art Pott stoker slant grate was 6.5 lb., or 13% by weight. A similar run was conducted for the presently taught horizontal grate with the same two weight measurements being made. The weight of ash was just 4.0 lb, or 8% by weight of the coal charge. This is a 38% reduction in the amount of disposable ash from the prior art stoker with the same amount of starting coal. This also indicates that 2.5 lb. more of rice coal were combusted in the stoker of the present invention.

A second comparative run of the two stokers (50 lb. coal charge to each hopper) produced comparable data, to 7.29 lb. for the prior art stoker, vs. 4.47 lb. of ash for the inventive stoker. The second run showed that that 2.82 lbs more (7.29–4.47) was combusted on the horizontal vs. the slant grate. The reduction in the ash amount was 38.5% for the second run.

Qualitatively, the ash from the flat grate stoker was markedly more dense than the ash collected from the horizontal grate unit. A quality control expert concluded that the anthracite coal was burned more completely in the inventive stoker of the present invention. This was confirmed by the marked variance in the measurable ash from each run, confirming fuller coal combustion.

Since many modifications, variations, and changes in detail may be made to the presently described embodiments, it is intended that all matter in the foregoing description, accompanying drawings, and formal claims being interpreted as illustrative and not by way of limitation.

I claim:

1. In a motorized coal stoker including a coal feed hopper with a lower forward passage, a base box forming an ash pit, a rearward ramp adapted to receive coal from the bottom of the hopper, and a pusher assembly disposed in the lower forward passage, eccentric movement means operably connected to the pusher assembly for causing reciprocating action, and a forward stationary planar fire grate for receiving particulate coal incrementally from the pusher means, the improvement comprising:

a) aligning the stationary planar fire grate component between its longitudinal ends, with one end thereof being secured to the rearward ramp, the stationary planar fire grate being in a substantially horizontal configuration, which serves to enhance the degree of coal combustion as coal incrementally translates across the fire grate components; and b) wherein the substantially horizontal fire grate has a multiplicity of perforations and which grate forms the top segment of the base box, and which box receives an adjustable supply of forced air flowing therethrough into the grate perforations.

2. The stoker of claim 1 wherein the pusher assembly in the reciprocating action effects moving a defined quantity of coal from the hopper lower passage moving onto the fire grate component in incremental amounts.

3. The stoker according to claim 1 wherein the stoker includes an open bottom and an open top storage bin communicating with a hopper top.

4. The stoker according to claim 1 wherein the stoker includes means for effecting the forced air flow to the grate using an impeller fan.

5. The stoker according to claim 1 wherein the stoker includes means wherein the forced air flow is made variable in volume per unit of time.

6. The stoker according to claim 1, wherein the stoker includes an opposing set of steeper sidewalls which abut the lateral edges of the elongate grate component.

7. The stoker of claim 1, wherein the fire grate component is parallel to the surface on which the stoker is positioned.

* * * * *